US006170614B1

(12) United States Patent
Herkel et al.

(10) Patent No.: US 6,170,614 B1
(45) Date of Patent: Jan. 9, 2001

(54) ELECTRONIC OVERSPEED GOVERNOR FOR ELEVATORS

(75) Inventors: Peter Herkel; Uwe Schönauer, both of Farmington, CT (US)

(73) Assignee: Otis Elevator Company, Farmington, CT (US)

( * ) Notice: Under 35 U.S.C. 154(b), the term of this patent shall be extended for 0 days.

(21) Appl. No.: 09/222,221

(22) Filed: Dec. 29, 1998

(51) Int. Cl.[7] ..... B66B 5/06
(52) U.S. Cl. ..... 187/287
(58) Field of Search ..... 187/287, 288; 361/23

(56) References Cited

U.S. PATENT DOCUMENTS

| | | | | |
|---|---|---|---|---|
| 4,350,225 | * | 9/1982 | Sakata et al. | 187/29 R |
| 4,378,059 | * | 3/1983 | Hatakeyama et al. | 187/29 R |
| 4,491,198 | * | 1/1985 | Noda et al. | 187/29 R |
| 4,662,481 | | 5/1987 | Morris et al. | 187/77 |
| 4,898,263 | * | 2/1990 | Manske et al. | 187/133 |
| 5,052,523 | | 10/1991 | Ericson | 187/89 |
| 5,065,845 | | 11/1991 | Pearson | 187/89 |
| 5,070,967 | | 12/1991 | Katzy et al. | 187/116 |
| 5,323,877 | | 6/1994 | Mori | 187/91 |
| 5,377,786 | | 1/1995 | Nakagawa | 187/276 |
| 5,407,028 | * | 4/1995 | Jamieson et al. | 187/288 |
| 5,487,450 | | 1/1996 | Gerber | 187/367 |
| 5,648,644 | | 7/1997 | Nagel | 187/288 |
| 5,648,645 | | 7/1997 | Arpagaus et al. | 187/393 |
| 5,869,794 | * | 2/1999 | Spiess | 187/287 |

FOREIGN PATENT DOCUMENTS

| | | |
|---|---|---|
| 0712804 | 5/1996 | (EP) . |
| 0543154 | 9/1997 | (EP) . |
| 0812796 | 12/1997 | (EP) . |
| 0856485 | 1/1998 | (EP) . |
| 0841282 | 5/1998 | (EP) . |
| 0662445 | 4/1999 | (EP) . |
| 3124688 | 5/1991 | (JP) . |
| 4246079 | 9/1992 | (JP) . |
| 4365771 | 12/1992 | (JP) . |
| 5147852 | 6/1993 | (JP) . |
| 5262472 | 10/1993 | (JP) . |
| 6255949 | 9/1994 | (JP) . |
| 8198543 | 8/1996 | (JP) . |
| 9040317 | 2/1997 | (JP) . |
| WO9842610 | 1/1998 | (WO) . |
| WO9842610 | 10/1998 | (WO) . |

OTHER PUBLICATIONS

Otis Invention Disclosure No. OT–4556 entitled Mechanical Resetting for Switch (Apolo Governor) dated Apr. 27, 1999.

* cited by examiner

*Primary Examiner*—Jonathan Salata

(57) ABSTRACT

An electronic overspeed governor for preventing elevator overspeed by enabling safety devices. The electronic overspeed governor includes a microprocessor assembly designed to interface with existing sensors, detectors, components, and safety equipment of current operational and production elevator systems. The microprocessor assembly receives very accurate position measurements from a position measurement system. The microprocessor receives configuration information from a rom which contains data specific to the particular model of elevator and other installation specific parameters. The software calculates elevator speed based on successive position data. If an overspeed or near overspeed condition occurs, the microprocessor generates the appropriate outputs to be conveyed to the elevator safety system. The safety system activates devices to arrest the overspeed condition. The microprocessor and associated components provide an overspeed governor which is faster, more accurate and reliable than the prior art.

11 Claims, 3 Drawing Sheets

ELECTRONIC OVERSPEED GOVERNOR FOR ELEVATORS

TECHNICAL FIELD

The present invention is generally directed to safety equipment used in elevator systems and more particularly, the present invention is directed to an improved overspeed governor using modern electronic components.

BACKGROUND OF THE INVENTION

The present invention is an improvement over the prior art. Specifically, state of the art overspeed governors are implemented mechanically based on a centrifugal governor. A separate system is installed in the hoistway to connect the car to the governor. The governor is mounted on a non-moving platform, usually at the top or bottom of the hoistway and is connected to the elevator by a rope, tension device, and a tension switch. Thus, the movement of the rope due to the movement of the elevator causes the mechanical overspeed governor to spin. The rate of spin determines the amount of centrifugal force and thus the linear displacement of a set of movable weights. The displacement of the weights determines whether or not the elevator is in an overspeed condition, and if so triggers a predetermined safety sequence of events.

Up until very recently, almost all countries required that elevator safety systems be mechanically implemented because of concerns that electronic implementations would be incapacitated by power failures. However regulations have changed in light of the recognized ability of electronic engineers and improved technology. These new designs provide for a fail safe mode in the event of power failures.

Therefore it has been determined that a need exists for an improved design of the overspeed governor which increases reliability, lowers part count and manufacturing costs, all while improving operability.

DISCLOSURE OF THE INVENTION

In accordance with a preferred embodiment of the present invention, an electronic overspeed governor for preventing elevator overspeed by enabling safety devices comprises a microprocessor assembly designed to interface with existing sensors, detectors, components, and safety equipment of current operational and production elevator systems. The microprocessor assembly receives very accurate position measurements from a position measurement system, such as the one disclosed in "Sonic Position Measurement System", U.S. patent application Ser. No.: 08/996,348, filed on Dec. 22, 1997, and hereby incorporated by reference. A microprocessor receives configuration information from an onboard ROM which contains data specific to the particular model of elevator and other installation specific parameters. The software calculates elevator speed based on successive position data. If an overspeed or near overspeed condition occurs, the microprocessor generates the appropriate outputs to be conveyed to the elevator safety system. The safety system activates devices to arrest the overspeed condition. The microprocessor and associated components provide an overspeed governor which is faster, more accurate and as reliable as the prior art. The improved electronic overspeed governor greatly improves installation time, reliability, quality, manufacturing costs, and operational characteristics.

The above-discussed and other features and advantages of the present invention will be appreciated and understood by those skilled in the art from the following detailed description and drawings.

BRIEF DESCRIPTION OF THE DRAWINGS

Referring now to the drawings wherein like elements are numbered alike in the several FIGURES.

BEST MODE FOR CARRYING OUT THE INVENTION

Figure 1:
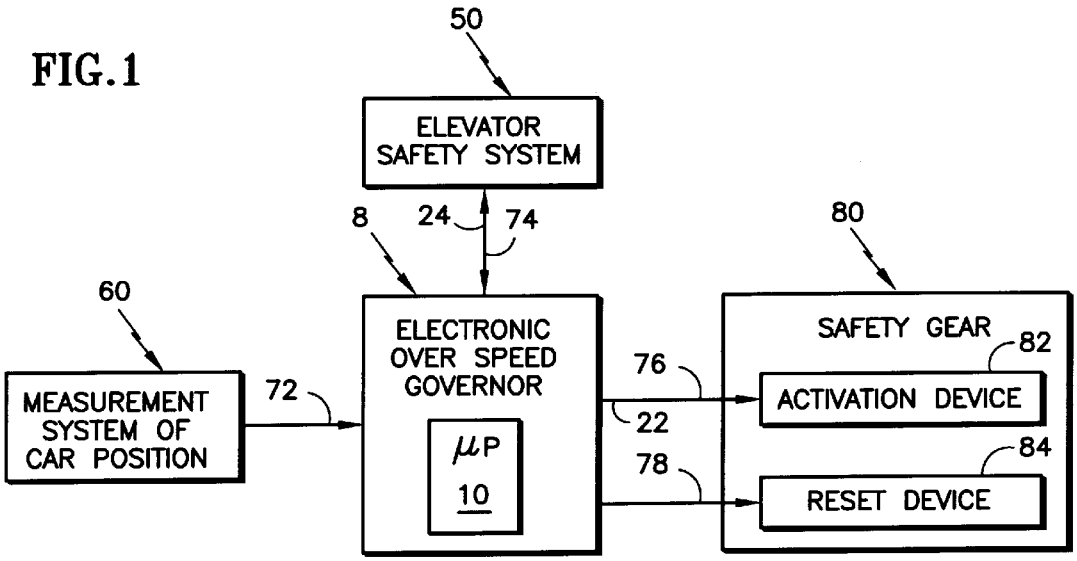
FIG. 1 is a high level system block diagram of an electronic overspeed governor illustrating the system components and interfaces.
Figure 5:
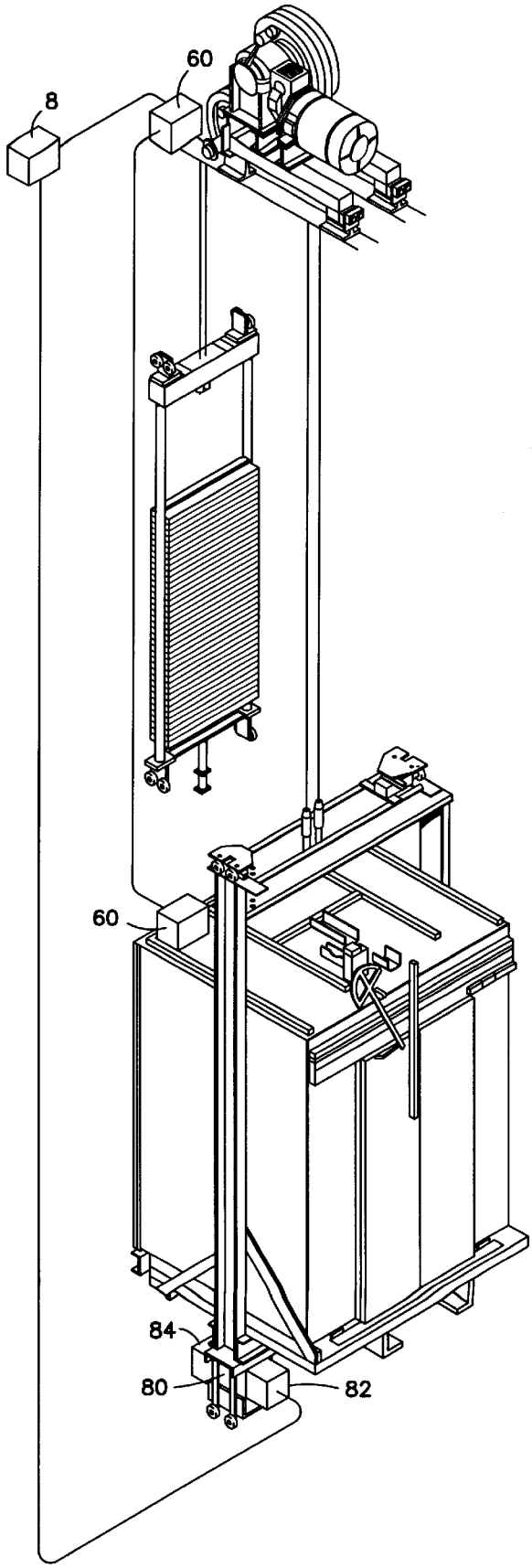
FIG. 5 is an illustrative example of an elevator system, governor and safety system.

Referring now to FIG. 1, a high level system block diagram of an electronic overspeed governor 8 illustrating the system components and interfaces is shown, and FIG. 5, an illustration of an elevator system is shown. An electronic overspeed governor 8 is designed to communicate with an elevator car position measurement system 60, so that in an operational mode, the electronic overspeed governor 8 receives continuous position data over the position measurement system/electronic overspeed governor interface 72. The elevator car position measurement system may be any known measurement system that provides the location of the elevator car. The elevator car position data is processed by a software program executing on a microprocessor assembly 10 as described in greater detail below.

The electronic overspeed governor 8 first determines an actual elevator car velocity from the position data and compares such actual velocity with a threshold velocity. If the actual velocity exceeds the threshold velocity, then an overspeed condition is detected. Once an overspeed condition has been determined by the electronic overspeed governor 8, an activation signal 22 is generated by the electronic overspeed governor 8 and outputted on a electronic overspeed governor/activation device communication interface 76. The activation signal is received by the safety gear 80 and in particular directed to the activation device 82. The activation device 82 deploys a braking system which arrests the elevator car in a safe and desirable manner. The braking system may be include a pre-tensioned device (e.g. spring) which is released by switching off a solenoid in response to the activation signal.

If the software program executing on the microprocessor 11 determines that a reset mode has been entered, then a reset signal is outputted on a electronic overspeed governor/reset device communication interface 78. The reset device 84 resets the braking system so that the elevator car is restored into service. The reset device may include a motor to tension a tension device in the activation device.

The elevator safety system 50 communicates with the electronic overspeed governor 8 over an electronic overspeed governor/elevator safety system communication interface 74. Elevator safety system data 24 is passed between the electronic overspeed governor 8 and elevator safety system 50 to facilitate software updates, operational status, alarm conditions, initialization, and other monitoring features as described in greater detail below.

Figure 2:
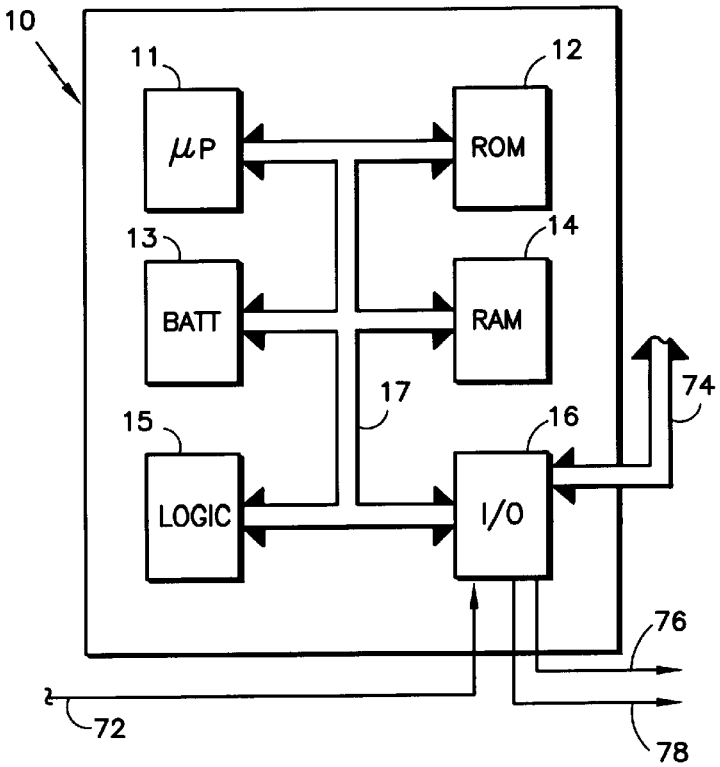
FIG. 2 is a high level system block diagram of a microprocessor assembly illustrating the system components and interfaces.

Referring to FIG. 2, a high level system block diagram of an microprocessor assembly 10 illustrating the system components is shown. A general purpose controller or microprocessor 11 is connected to a read-only memory (ROM) 12, a random access memory (RAM) 14, a power back up unit (BATT) 13, a logic unit 15 and an input/output communications port (I/O) 16 over a microprocessor system bus 17.

The microprocessor 11 executes a software program stored in the ROM 12. The ROM 12 also contains tables of data for the particular elevator installation including one or more threshold velocities. Multiple threshold velocities may be stored for different operating modes of the elevator. For example, a first velocity threshold may be stored for upward movement and a second velocity threshold may be stored for downward movement. Such data may also contain installation parameters such as number of floors, distance between floors, overspeed threshold values, filter coefficients, and other such data required for initialization and operational software program execution. The ROM 12 may be designed from Flash ROM, so that software updates may be downloaded from the elevator safety system 50 over the electronic overspeed governor/elevator safety system interface 74. This method may be used to effect code changes, data changes or both.

The RAM 14 is used for temporary storage of data values during software execution. It may also hold certain data received from the I/O 16 unit or other data ready for transmission to the I/O 16 unit. The RAM 14 may be designed from non-volatile random access memory (NVRAM) components so as to retain data through any power supply failures, main or backup.

The power back up unit 13 is designed to provide power to the microprocessor assembly 10 until a safe power down can be executed in the event of a main power supply (not shown) failure. When the software program detects that the main power supply has failed, it calls the activation routine so as to generate an activation signal which causes the activation device 82 to arrest the elevator car.

Position data is received by the microprocessor assembly 10 over the position measurement system/electronic overspeed governor communications interface 72. The activation signal is transmitted over the electronic overspeed governor/activation device communications interface 76. The reset signal is transmitted over the electronic overspeed governor/reset device communications interface 78. Commands and data are communicated between the electronic overspeed governor 8 and the elevator safety system 50 over the electronic overspeed governor/elevator safety system communications interface 74.

The microprocessor assembly 10 may be mounted in such a manner as to detect a pin configuration, thus sensing the model elevator it is being installed upon. Such configuration sensing helps assure that the correct software program installed in the ROM 12 is appropriate for the particular elevator the electronic overspeed governor is being installed upon.

Figure 3:
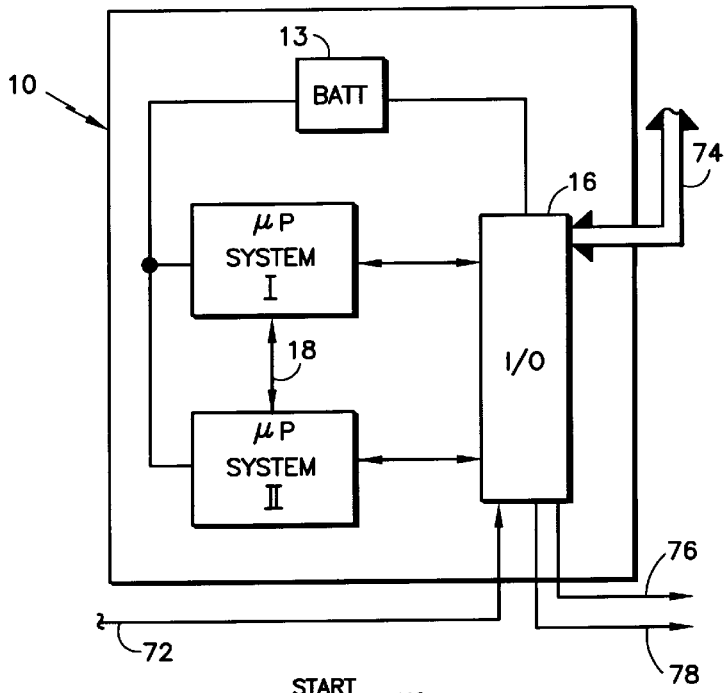
FIG. 3 is a high level system block diagram of a microprocessor assembly illustrating two microprocessor systems and their interfaces.

Referring to FIG. 3, a second embodiment of the microprocessor assembly 10 is shown. In this embodiment there are two microprocessor systems I & II with a serial data communication bus 18 between them for exchanging data and commands. Each of these microprocessor systems I & II has its own microprocessor 11, ROM 12, RAM 14 and logic unit 15. However the battery unit 13 and the I/O 16 unit is shared between the two microprocessor systems I & II. The two microprocessor systems I & II may be configured to operate in several different modes. The first mode is a master/slave relationship where one of the microprocessor systems, either I or II is designated the master, receives the position data over the position measurement system/microprocessor interface 72, performs computations to determine if an overspeed condition exists, and if so outputs the activation signal over the microprocessor/activation device interface 76. The remaining microprocessor system, the slave, operates in a monitor mode only, detecting a fault signal or fault condition from the master microprocessor system. Another way to control the slave is through an active watch dog timer whereby if the master does not reset the slave's watch dog timer periodically, the slave assumes the master has failed, detects a fault condition, and begins to execute it's own master routines.

A second mode of operation for the two microprocessor systems I & II is a comparison mode whereby each of the microprocessor systems I & II is simultaneously receiving the periodic position data from the position measurement system 60. Each microprocessor system I & II then performs its own calculations as to determining whether an overspeed condition exists. A voting algorithm is implemented to determine whether or not an activation signal should be issued to the input/output port 16. The voting algorithm may be simple or complex, but it cannot be time consuming, given the fact that the elevator car may have issued an urgent request to the safety system. As a result of the voting algorithm, one of the two microprocessor systems may issue an activation signal on the first occurrence of an overspeed condition or it may have a filter to overcome any false overspeed conditions detected. The algorithm can be altered to match the requirements of the installation. A third mode of operation for the two microprocessor systems I & II is an independent mode whereby each of the microprocessor systems I & II independently receives the position data over the position measurement system/microprocessor interface 72, independently performs computations to determine if an overspeed condition exists, and if so, independently outputs the activation signal over the microprocessor/activation device interface 76. Thus either of the two microprocessor systems I & II may cause the safety gear 80 to be engaged and subsequently reset.

Figure 4:
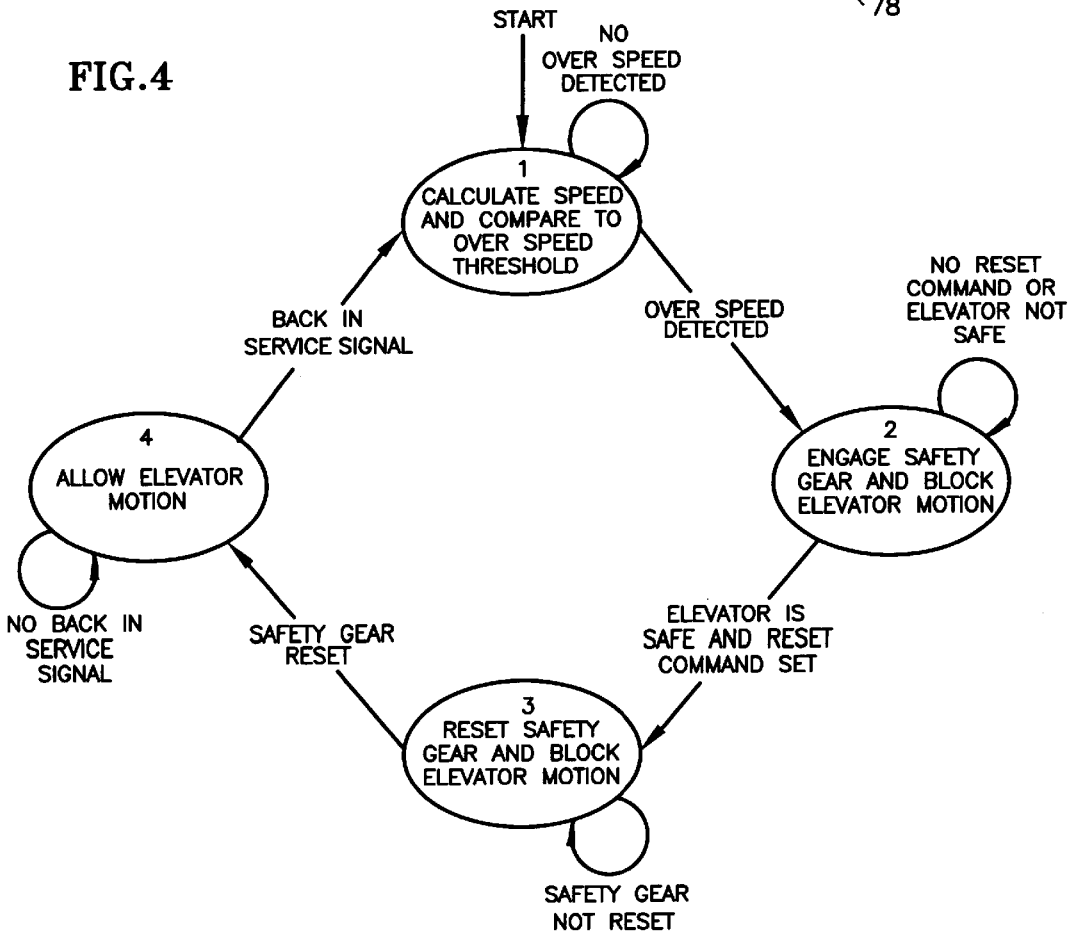
FIG. 4 is a state diagram illustrating the states of the electronic overspeed governor.

Referring to FIG. 4, a state diagram illustrating the states of the electronic overspeed governor 8 is shown. In the first state 1, the electronic overspeed governor 8 receives position data, compares it against the overspeed threshold, and determines if an overspeed condition exists. If no overspeed condition is detected, the governor 8 remains in the first state 1 repeating the comparison task. If an overspeed condition is detected, the governor 8 transitions to a second state 2. In the second state 2, the electronic overspeed governor 8 outputs the activation signal to engage the safety gear and block elevator motion. In the second state 2, the governor 8 awaits a reset signal. If no reset signal is received or the elevator is not safe, the electronic overspeed governor 8 remains in the second state 2. If a reset signal is received and the elevator is safe, the electronic overspeed governor 8 transitions into a third state 3 where a reset signal is output to reset the safety gear and allow elevator motion. If the safety gear is not successfully reset as commanded, the overspeed governor 8 remains in the third state 3. If the safety gear is successfully reset as commanded, the overspeed governor 8 transitions to the fourth state 4. In the fourth state 4, limited elevator motion is allowed. If a back in service signal is not received, the overspeed governor 8 remains in the fourth state 4. If a back in service signal is received, the overspeed governor 8 transitions to the first state where normal operations are again commenced. It should be noted that the communication interfaces above may be serial or parallel, proprietary or standardized. They may also be implemented by electrical, optical, or telemetry means.

From the above, it should be appreciated that the systems and apparatus described herein provide a reliable electronic overspeed governor for elevator cars. It should also be appreciated that the electronic overspeed governor apparatus of the present invention permits the reduction of parts, required service, adjustment points, and failure modes while increasing reliability of the elevator and maintaining its safety.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. An electronic overspeed governor for use in elevator system comprising:

an input/output port receiving a position signal indicative of an elevator car position and providing an activation signal to an activation device of an elevator safety system, wherein the elevator safety system stops the movement of the elevator system in response to the activation signal;

a memory device storing a threshold velocity;

a microprocessor coupled to said input/output port, said microprocessor computing an elevator car velocity value in response to said position signal and comparing said elevator car velocity value to said threshold velocity;

wherein said microprocessor generates the activation signal in response to said comparing said elevator car velocity value to said threshold velocity.

2. An electronic overspeed governor system as in claim 1 further comprising:

a further microprocessor in communication with said microprocessor and in communication with said input/output port, said further microprocessor computing a further elevator car velocity value in response to said position signal and comparing said further elevator car velocity value to said threshold velocity;

wherein one of said microprocessor and said further microprocessor generates said activation signal in response to said comparing performed by said microprocessor and said comparing performed by said further microprocessor.

3. An electronic overspeed governor system as in claim 1 further comprising:

a further microprocessor in communication with said microprocessor and in communication with said input/output port, said further microprocessor detecting a fault condition;

wherein said further microprocessor serves as said microprocessor upon detection of said fault condition.

4. An electronic overspeed governor system as in claim 1 wherein:

said memory device is a read only memory having an executable program executed by said microprocessor and a plurality of preset data.

5. An electronic overspeed governor system as in claim 1 wherein:

said memory device stores a first velocity threshold for use in a first elevator mode and a second velocity threshold for use in a second elevator mode.

6. An elevator system comprising:

a measurement device generating a position signal in response to a position of an elevator car;

an electronic overspeed governor including:

an input/output port receiving said position signal;

a memory device storing a threshold velocity;

a microprocessor coupled to said input/output port, said microprocessor computing an elevator car velocity value in response to said position signal and comparing said elevator car velocity value to said threshold velocity, said microprocessor generating an activation signal in response to said comparing said elevator car velocity value to said threshold velocity; and an activation device of an elevator safety system for activating said elevator safety system in response to said activation signal.

7. An elevator system of claim 6 further comprising:

a reset device for returning said activation device to an original state in response to a reset signal;

wherein said microprocessor generates said reset signal.

8. An elevator system of claim 6 further comprising:

an elevator safety system in communication with said electronic overspeed governor.

9. A method for controlling an elevator braking system comprising:

monitoring a position of an elevator car;

determining an elevator car velocity in response to the position of the elevator car;

comparing the elevator car velocity to a velocity threshold; and activating a braking system in response to said comparing the elevator car velocity to a velocity threshold.

10. A method for controlling an elevator braking system of claim 9 wherein:

said velocity threshold includes a first velocity threshold for use in a first elevator mode and a second velocity threshold for use in a second elevator mode.

11. A method for controlling an elevator braking system of claim 9 wherein:

said comparing comprises performing a first comparison and performing a second comparison; and said activating is in response to said first comparison and said second comparison.

* * * * *